US008816575B2

(12) United States Patent
Kimiya et al.

(10) Patent No.: US 8,816,575 B2
(45) Date of Patent: Aug. 26, 2014

(54) SOCKET AND LAMP ENGAGEMENT CONFIGURATIONS FOR A LUMINAIRE

(71) Applicant: Toshiba Lighting & Technology Corporation, Yokosuka (JP)

(72) Inventors: Junichi Kimiya, Yokosuka (JP); Kenji Nezu, Yokosuka (JP); Go Kato, Yokosuka (JP); Yoshiyuki Tamaki, Yokosuka (JP); Hiroto Nakamura, Yokosuka (JP); Kazunari Higuchi, Yokosuka (JP); Makoto Otsuka, Minato-ku (JP); Yoshiyuki Tomizawa, Minato-ku (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 13/690,402

(22) Filed: Nov. 30, 2012

(65) Prior Publication Data

US 2014/0055022 A1 Feb. 27, 2014

(30) Foreign Application Priority Data

Aug. 23, 2012 (JP) ..... 2012-184413

(51) Int. Cl.
*H01J 1/02* (2006.01)
*H01J 7/24* (2006.01)

(52) U.S. Cl.
USPC ..... 313/45; 313/11

(58) Field of Classification Search
None
See application file for complete search history.

(56) References Cited

U.S. PATENT DOCUMENTS

| | | | | |
|---|---|---|---|---|
| 7,344,296 | B2 * | 3/2008 | Matsui et al. | 362/652 |
| 8,506,133 | B2 | 8/2013 | Tomiyoshi et al. | |
| 2012/0127733 | A1 | 5/2012 | Tomiyoshi et al. | |
| 2012/0127741 | A1 * | 5/2012 | Osada et al. | 362/373 |
| 2013/0010473 | A1 | 1/2013 | Dellian et al. | |

FOREIGN PATENT DOCUMENTS

| | | | |
|---|---|---|---|
| DE | 102010003073 | A1 | 9/2011 |
| EP | 2450616 | A1 | 5/2012 |
| JP | 2004265626 | A | 9/2004 |
| JP | 2012-109157 | A | 6/2012 |

OTHER PUBLICATIONS

Extended European search report for application No. 12191515.1 mailed Nov. 19, 2013.

* cited by examiner

*Primary Examiner* — Natalie Walford
(74) *Attorney, Agent, or Firm* — Banner & Witcoff, Ltd..

(57) ABSTRACT

An LED module substrate includes a substrate main body, an LED mounted on one plane of the substrate main body, and a contact mounted at an edge of the one plane of the substrate main body and electrically connected to the LED. A cover section covers the LED module substrate in which the contact and the thermal radiation sheet are exposed. A lamp is attached to a socket. The socket includes a terminal electrically connected to the contact by the attachment of the lamp. A luminaire main body includes a thermal radiator including a contact surface and a recess. The lamp attached to the socket is brought into contact with and thermally connected to the contact surface. The recess is provided in a position opposed to the terminal of the socket.

9 Claims, 12 Drawing Sheets

SOCKET AND LAMP ENGAGEMENT CONFIGURATIONS FOR A LUMINAIRE

INCORPORATION BY REFERENCE

This application claims priority under 35 U.S.C. §119 to Japanese Patent Application No. 2012-184413 filed on Aug. 23, 2012. The content of the application is incorporated herein by reference in its entirety.

FIELD

Embodiments described herein relate generally to a luminaire that may include, in a luminaire main body, a thermal radiator including a connecting section with which a lamp may be brought into contact and thermally connected.

BACKGROUND

In the past, for example, there is a lamp including a GX53-type cap as a flat-type lamp used in a luminaire such as a downlight arranged to be embedded in a setting surface of the ceiling or the like. The lamp includes a light-emitting module substrate including LEDs, which are semiconductor light-emitting devices, as light sources, a housing configured to house the light-emitting module substrate and having translucency in a lower part opposed to the light-emitting module substrate, a GX53-type cap including a pair of lamp pins provided on the upper side of the housing, and a thermal radiation sheet arranged in the cap. In the lamp, after the cap is pressed against a socket attached to a luminaire main body of a luminaire, the lamp is attached to the socket by being rotated a predetermined angle. In this attached state, the cap is electrically connected to a power supply side. The thermal radiation sheet is brought into contact with a thermal radiator of the luminaire main body and thermally connected thereto. Consequently, it is possible to radiate heat generated in the LEDs.

DETAILED DESCRIPTION

According to one embodiment, a luminaire includes a lamp, a socket, and a luminaire main body. The lamp includes a module substrate, and a cover section. The module substrate includes a substrate main body, a light source mounted on one plane of the substrate main body, and a contact mounted at an edge of the one plane of the substrate main body and electrically connected to the light source. The cover section covers the module substrate in a state in which the contact is exposed. The lamp is attached to the socket. The socket includes a terminal electrically connected to the contact by the attachment of the lamp. The luminaire main body includes a thermal radiator including a connecting section and an insulating section. The lamp attached to the socket is brought into contact with and thermally connected to the connecting section. The insulating section is provided in a position opposed to the terminal of the socket.

The configuration of a luminaire according to a first embodiment is explained below with reference to FIGS. 1 to 9.

Figure 9:
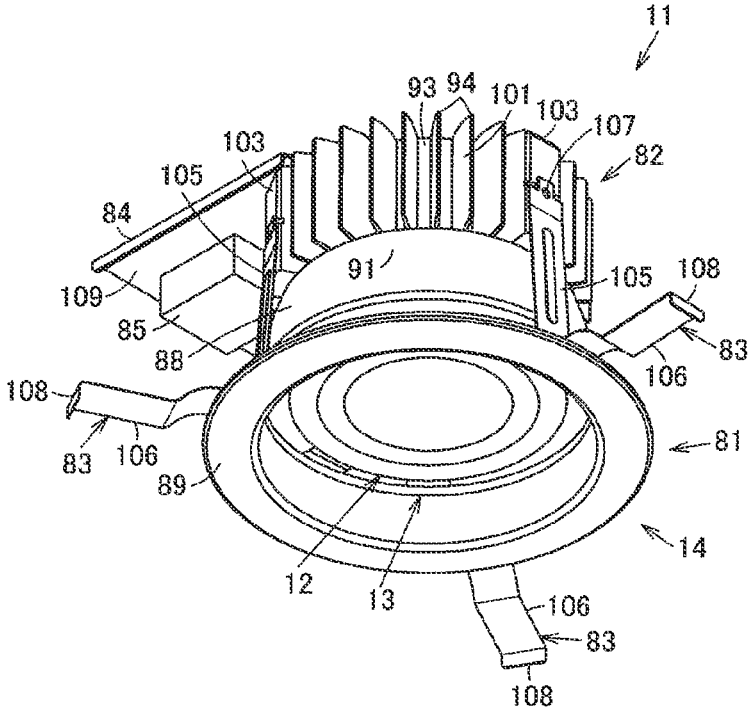
FIG. 9 is a perspective view of the luminaire viewed from below.

As shown in FIG. 9, a luminaire 11 is an embedded-type luminaire such as a downlight. The luminaire 11 is set in a state in which the luminaire 11 is embedded in a circular embedding hole provided in a setting section such as a ceiling plate.

As shown in FIGS. 1 to 9, a flat-type lamp 12 is used in the luminaire 11. The lamp 12 is locked to a luminaire main body 14 via a socket 13. The lamp 12 includes an LED module substrate 16 functioning as a module substrate mounted with LEDs 15, which are semiconductor light-emitting devices (solid-state light-emitting devices) functioning as light sources, on the lower surface, which is one plane, an insulative thermal radiation sheet 17 attached to the other plane side, which is an opposite light-emitting side, e.g., the upper surface side of the LED module substrate 16, and a cover section 18, which is a housing that covers the one plane side of the LED module substrate 16.

The LED module substrate 16 is a light-emitting module substrate of a COB (Chip ON Board) system in which the LEDs 15 are arranged and mounted in a matrix shape on a substrate main body 20 formed in, for example, a circular shape. A light control unit 21, which is a collimator lens for diffusing emitted light, is attached to the LEDs 15. A square projection 22 projecting in the radial direction is protrudingly provided at an edge of the substrate main body 20. A contact section 24 having a plurality of contacts 23 electrically connected to the LEDs 15 is arranged in the projection 22. The LED module substrate 16 is fixed to the cover section 18 by a screw 25.

In the projection 22, the contacts 23 are arranged spaced apart from one another along a direction crossing (orthogonal to) the radial direction of the substrate main body 20.

Figure 3:
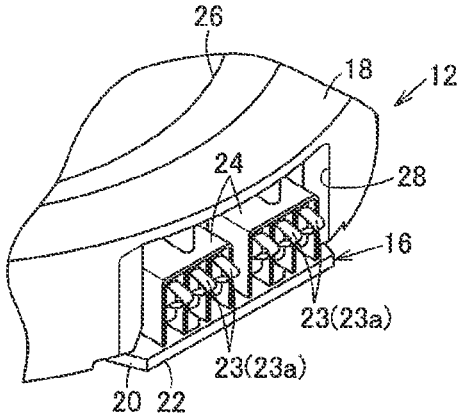
FIG. 3 is a perspective view of the vicinity of a contact of the lamp.

The contacts 23 are formed by bending elongated metal pieces having electric conductivity. Distal ends 23*a*, which are lower ends, of the contacts 23 are folded back in a loop shape. The distal ends 23*a* project from the projection 22 to a side, e.g., the outside of the cover section 18. The distal ends 23*a* are elastically deformed in the horizontal direction crossing (e.g., orthogonal to) the up-down direction (e.g., the vertical direction), which is an attaching direction of the lamp 12 to the socket 13, to apply spring pressure (FIG. 3).

The contact section 24 is formed of an insulative material. The contact section 24 is formed to partition the periphery of the contacts 23 in the projection 22 to insulate the contacts 23 from one another.

A thermal radiation sheet 17, for example, a soft silicone sheet, excellent in heat conductivity may be used. The thermal radiation sheet 17 is directly attached to the upper surface of the LED module substrate 16 and thermally connected to the substrate main body 20 (and, thus, the LEDs 15) of the LED module substrate 16.

The cover section 18 is formed in a bottomed cylindrical shape. The thermal radiation sheet 17 is exposed on the upper side of the cover section 18. A circular emission opening 26 is opened in the bottom of the cover section 18 opposed to the LEDs 15. The emission opening 26 is closed by the light control unit 21. An opening section 28 for exposing the contact section 24 (the contacts 23) to the outside is cut out and formed in the outer circumference of the cover section 18. Further, a plurality of, for example, three, engagement recesses 29 functioning as engaging sections are formed spaced apart, e.g., at an equal intervals (an equal angle), in the circumferential direction in the outer circumference of the cover section 18.

In the engagement recesses 29, locking protrusion parts 31 functioning as lamp-side locking sections for locking the lamp 12 to the socket 13 (and, thereby, the luminaire main body 14) are protrudingly provided outward along the radial direction. The engagement recesses 29 respectively communicate with openings 32 opened to the outside of the emission opening 26 in the bottom of the cover section 18. The openings 32 are openably closed by closing members 33.

The locking protrusion parts 31 are located in the engagement recesses 29 to prevent the distal end sides from projecting from the outer wall of the cover section 18. The upper sides of the locking protrusion parts 31 are formed as upper inclined surfaces 35 functioning as lamp-side guide surfaces. The lower sides of the locking protrusion parts 31 are formed as lower inclined surfaces 36 functioning as lamp side locking surfaces.

The upper inclined surfaces 35 are located at the upper ends of the engagement recesses 29. The upper inclined surfaces 35 incline downward to the outer side in the radial direction.

The lower inclined surfaces 36 continue to the lower ends of the upper inclined surfaces 35. The lower inclined surfaces 36 incline downward to the inner side in the radial direction, e.g., the center side of the cover section 18.

The socket 13 includes a socket main body 41 formed of, for example, insulative synthetic resin in an annular shape and a plurality of, for example, three, locking lock units 42, which are latches functioning as socket-side locking sections, arranged in the socket main body 41 and for locking the lamp 12 to the socket 13.

In the socket main body 41, an annular section 45 is formed. An outer edge section 46 projecting upward from the outer circumference of the annular section 45 is formed. Further, an inner cylinder 47 projecting downward from the inner circumference of the annular section 45 is formed.

In the annular section 45, housing sections 51 in which the locking lock units 42 are respectively fit and housed are formed along the radial direction and spaced apart, e.g., at substantially equal intervals (equal angles), in the circumferential direction. In the annular section 45, a plurality of boss-shaped screwing sections 53, in which a plurality of screws 52 for fixing the socket 13 and the luminaire main body 14 are screwed, are formed in the vicinity of the housing sections 51.

Further, in the inner cylinder 47, a terminal section 56 in which terminals 55 are arranged is formed along the circumferential direction to project in the radial direction. The distal ends 23*a* of the contacts 23 of the contact section 24 of the lamp 12 attached to the socket 13 are brought into press contact with and electrically connected to the terminals 55.

Figure 4:
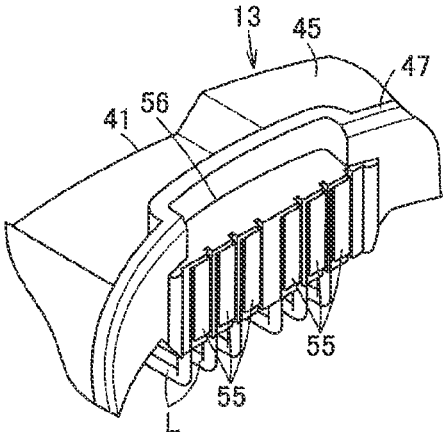
FIG. 4 is a perspective view of the vicinity of a terminal of a socket of the luminaire.
Figure 5:
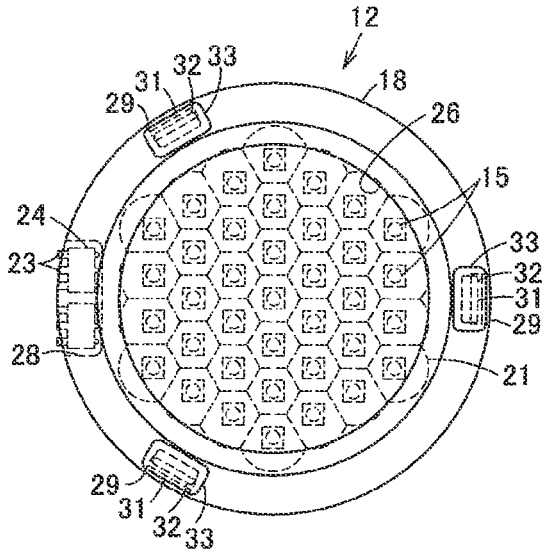
FIG. 5 is a plan view of the lamp.
Figure 6:
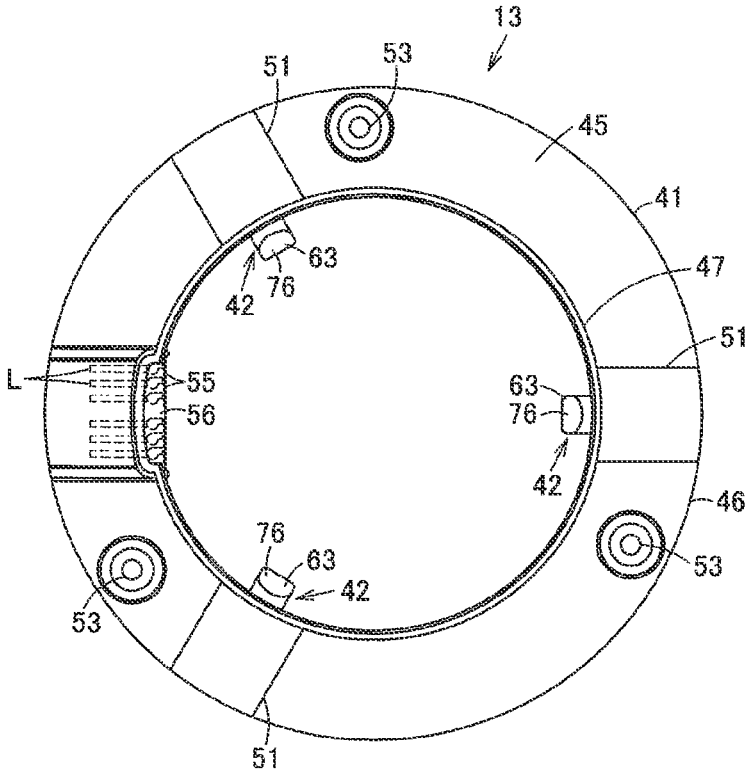
FIG. 6 is a plan view of the socket.

The terminals 55 are longitudinally arranged along the up-down direction. The terminals 55 are electrically connected to a not-shown external power supply (lighting circuit) via output lines L electrically connected to the terminals 55 (FIG. 4). The terminals 55 are electrically connected to the contacts 23 of the lamp 12 to thereby supply electric power (e.g., direct-current power) for lighting the LEDs 15.

The terminal section 56 is formed of an insulative material. The terminal section 56 is formed to partition the periphery of the terminals 55 to insulate the terminals 55 from one another.

Each of the locking lock units 42 includes a cylindrical guide section 61 functioning as a locking section main body fit and fixed in the housing section 51, a coil spring 62 functioning as an urging member housed on the inside of the cylindrical guide section 61, and a locking claw 63 functioning as a locking body urged by the coil spring 62.

Figure 7:
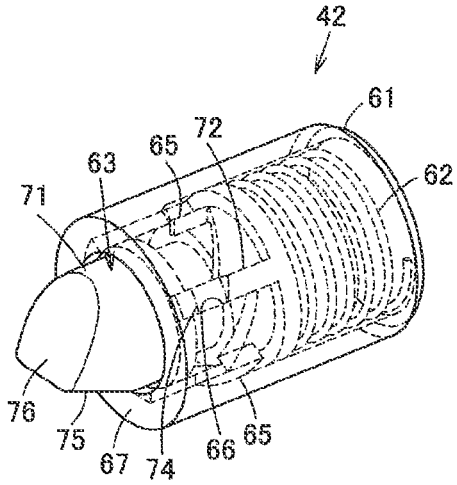
FIG. 7 is a perspective view of a part of the socket.
Figure 8:
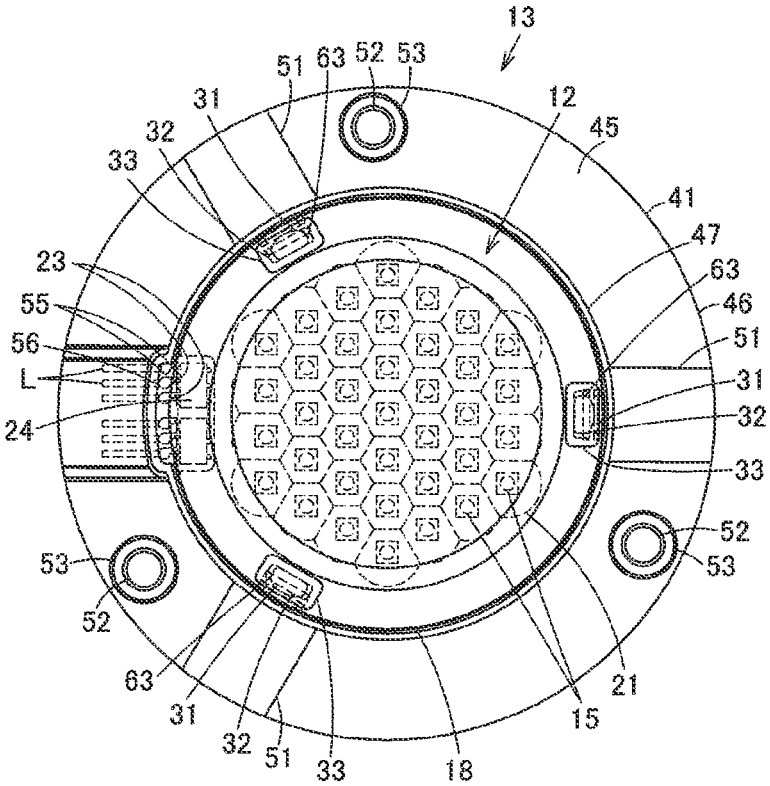
FIG. 8 is a plan view of a state in which the lamp is attached to the socket.

The cylindrical guide section 61 is housed in the housing section 51 to have an axis direction along the radial direction of the socket 13 (the socket main body 41). One end side of the cylindrical guide section 61 is in contact with the inner surface of the outer edge section 46 and the other end side is opposed to the inside of the inner cylinder 47. A plurality of guide protrusion parts 65 are formed spaced apart in the circumferential direction on the inside of the other end side of the cylindrical guide section 61. Groove sections 66 functioning as one guide section parallel to the axis direction are partitioned between the guide protrusion parts 65 adjacent to each other. Therefore, the locking claw 63 is prevented from turning in the circumferential direction with respect to the cylindrical guide section 61 by the groove sections 66. The cylindrical guide section 61 and the locking claw 63 are positioned in the circumferential direction. The locking claw 63 is movably guided along the axis direction of the cylindrical guide section 61. Further, a stopper section 67 functioning as a regulating section for regulating a projecting position of the locking claw 63 is protrudingly provided toward the center axis on the other end side of the cylindrical guide section 61 (FIG. 7).

One end side of the coil spring 62 is set in contact with and supported by the inner surface of the outer edge section 46 of the socket main body 41 on the one end side of the cylindrical guide section 61. The other end side of the coil spring 62 is set in contact with the locking claw 63.

The locking claw 63 includes a claw main body 71 functioning as a locking body main body and a spring receiving section 72 functioning as a supported section attached to the outside of the claw main body 71.

The claw main body 71 is formed in a long substantial cylindrical shape. A proximal end side, which is one end side, of the claw main body 71 is located on the inside of the other end side of the cylindrical guide section 61. A distal end side, which is the other end side (e.g., opposite to the one end side), of the claw main body 71 projects from the other end side of the cylindrical guide section 61 to the inside of the inner cylinder 47 of the socket main body 41 and can move along the axis direction of the cylindrical guide section 61. Guide ribs 74 functioning as the other guide section inserted into the grooves sections 66 are protrudingly provided along the axis direction around the claw main body 71. Further, an upper claw inclined surface 75 functioning as a socket side locking surface is formed on the upper side of the distal end of the claw main body 71. A lower claw inclined surface 76 functioning as a socket side guide surface is formed on the lower side of the distal end of the claw main body 71.

The upper claw inclined surface 75 declines downward to the inner side in the radial direction of the socket 13, i.e., the center side of the cover section 18.

The lower claw inclined surface 76 continues to the lower end of the upper claw inclined surface 75 and declines downward to the outer side in the radial direction of the socket 13.

The other end side of the coil spring 62 comes into contact with the spring receiving section 72, whereby the spring receiving section 72 receives urging of the coil spring 62.

The luminaire main body 14 includes a reflector 81, a thermal radiator 82 arranged in an upper part of the reflector 81, a plurality of attachment springs 83 attached on the circumferential surface of the thermal radiator 82, an attachment plate 84 attached to an upper part of the thermal radiator 82, and a plurality of terminal blocks 85 (only one is shown in the figure) attached to the attachment plate 84.

The reflector 81 is made of, for example, metal. The reflector 81 includes a cylindrical main body section 88 and an annular flange section 89 projecting outward from the lower end of the main body section 88.

The diameter of the main body section 88 is formed smaller than the diameter of an embedding hole. The diameter of the flange section 89 is formed larger than the diameter of the embedding hole. The main body section 88 gradually expands in diameter from the upper side to the lower side. A convection forming section 91 that enables convection of the air from the lower surface side to the upper surface side of the thermal radiator 82 is formed on the outer circumferential surface of the main body section 88.

The thermal radiator 82 is formed of a material such as metal, for example, aluminum die-cast, ceramics, or resin excellent in thermal radiation properties. The thermal radiator 82 includes a cylindrical base section 93 and a plurality of thermal radiation fins 94 radially projecting from the circumference of the base section 93.

A planar attachment surface 96, which is an attachment section with which the upper surface of the luminaire main body 14 is brought into contact and to which the upper surface is attached, is formed in a peripheral section of the base section 93 and lower parts of the thermal radiation fins 94. A circular contact projecting section 97 that closes the lower surface of the base section 93 and projects further downward than the attachment surface 96 is formed on the lower surface in the center of the base section 93. A contact surface 98 functioning as a planar connecting section is formed in a lower part of the contact projecting section 97. Not-shown ribs are radially formed on the inner side of the base section 93. On the contact surface 98, a recess 99 functioning as an insulating section is formed in a position opposed to the terminals 55 of the socket 13.

The recess 99 includes a longitudinal wall section 99*a* vertically standing upward from the contact surface 98 (e.g., the attachment surface 96) and a lateral wall section 99*b* extending in parallel to the contact surface 98 (e.g., the attachment surface 96), i.e., horizontally from the upper end of the longitudinal wall section 99*a*. Therefore, the recess 99 is separated from the upper surfaces of the thermal radiation sheet 17 and the projecting section 22 (e.g., the substrate main body 20) of the LED module substrate 16 by a predetermined distance set by the longitudinal wall section 99*a*.

Gaps 101 opening to the outer circumference, the lower surface of the thermal radiator 82, and the upper surface are formed among the plurality of thermal radiation fins 94.

A plurality of attachment sections 103 are formed around the base section 93 of the thermal radiator 82. Not-shown attachment holes, in which the screws 52 for fixing the socket 13, the luminaire main body 14, and the thermal radiator 82 are screwed, are formed in lower parts of the attachment sections 103.

The attachment springs 83 are formed by leaf springs (e.g., of metal). The attachment springs 83 include supporting pieces 105 and contact pieces 106 bent from the lower ends of the supporting pieces 105. In the attachment springs 83, the upper ends of the supporting pieces 105 are fixed to the outer side surfaces of the attachment sections 103 of the thermal radiator 82 by screws 107. The supporting pieces 105 are arranged along the side surface of the main body section 88 of the luminaire main body 14. The contact pieces 106 project to the side of the luminaire main body 14. Hooking sections 108 having a substantially L shape are formed at the distal ends of the contact pieces 106.

The attachment plate 84 is made of, for example, metal and fixed to the upper surface of the thermal radiator 82 by not-shown screws in a state in which the attachment plate 84 is in contact with the upper surface. A terminal block attaching section 109 projecting to the side of the thermal radiator 82 is formed on the attachment plate 84. The terminal blocks 85 are attached to the lower surface of the terminal block attaching section 109. In other words, the terminal blocks 85 are arranged in positions estranged to the side of the thermal radiator 82 by the attachment plate 84.

One of the terminal blocks 85 is a terminal block for, for example, a power supply and a ground and the other is a terminal block for, for example, a dimming signal. The terminal blocks 85 and the socket 13 are connected by a not-shown electric wire. The electric wire is connected from the socket 13 to the terminal blocks 85 through a not-shown wiring hole of the luminaire main body 14 and the gaps 101 among the thermal radiation fins 94 of the thermal radiator 82.

Assembly of the luminaire 11 is explained.

The luminaire main body 14 is fit in the circumference of the contact projecting section 97 of the thermal radiator 82, the socket 13 is inserted into the main body section 88 of the luminaire main body 14, and the luminaire main body 14 is held between the socket 13 and the thermal radiator 82. In this state, the screws 52 are screwed into the not-shown attachment holes of the thermal radiator 82 through the screwing sections 53 of the socket 13 and the not-shown attachment holes of the luminaire main body 14. The luminaire main body 14, the socket 13, and the thermal radiator 82 are integrally fixed in a state in which the luminaire main body 14 is held between the socket 13 and the thermal radiator 82.

When the socket 13 is inserted into the main body section 88 of the luminaire main body 14, the electric wire from the socket 13 drawn out to the outer side from the not-shown wiring hole of the luminaire main body 14 in advance is connected to the terminal blocks 85. The attachment plate 84 to which the terminal blocks 85 are attached is fixed to an upper part of the thermal radiator 82 by a plurality of screws.

Subsequently, the attachment springs 83 are fixed to the side surface of the thermal radiator 82 by the screws 107.

The contact surface 98 of the thermal radiator 82 is arranged to be exposed in the inner cylinder 47 of the socket 13.

Setting of the luminaire 11 is explained.

A power supply line, an ground line, a dimming signal line, and the like led in advance to the embedding hole of the setting section are drawn out from the embedding hole to below the setting section and connected to the terminal blocks 85 of the luminaire 11.

In a state in which the contact pieces 106 of the attachment springs 83 are elastically deformed along the side surface of the luminaire main body 14 and held, first, the luminaire 11 is tilted such that the terminal block attaching section 109 and the terminal blocks 85 of the attachment plate 84 face up. The terminal block attaching section 109 and the terminal blocks 85 of the attachment plate 84 are obliquely inserted into the embedding hole. Thereafter, while the luminaire 11 is reset to be horizontal, the thermal radiator 82 and the main body section 88 and the attachment springs 83 of the luminaire main body 14 are inserted into the embedding hole.

If the hooking sections 108 of the attachment springs 83 move to above the embedding hole, the holding of the attachment springs 83 is released. Consequently, the contact pieces 106 of the attachment springs 83 expand to the side of the luminaire main body 14 with a repulsive force against the elastic deformation. The contact pieces 106 come into contact with an upper edge section of the embedding hole and draw up the luminaire 11. The flange section 89 comes into contact with the lower surface of the setting section. The setting is completed.

When the luminaire 11 is detached from the setting section, the luminaire 11 is drawn down against a drawing-up force by the attachment springs 83. While the contact pieces 106 of the attachment springs 83 moved to below the embedding hole are elastically deformed along the side surface of the luminaire main body 14, the main body section 88 and the thermal radiator 82 of the luminaire main body 14 are moved to below the embedding hole. Further, in the same manner as the setting, the luminaire 11 is tilted and the terminal block attaching section 109 and the terminal blocks 85 of the attachment plate 84 are moved to below the embedding hole.

Attachment of the lamp 12 to the luminaire 11 is explained.

The lamp 12 is inserted into the inner side of the main body section 88 of the luminaire main body 14. The lamp 12 is pushed up in an upward direction, which is an attaching direction, and inserted into the socket 13 in a state in which the engaging recesses 29 are aligned with the locking lock units 42 of the socket 13.

Figure 1:
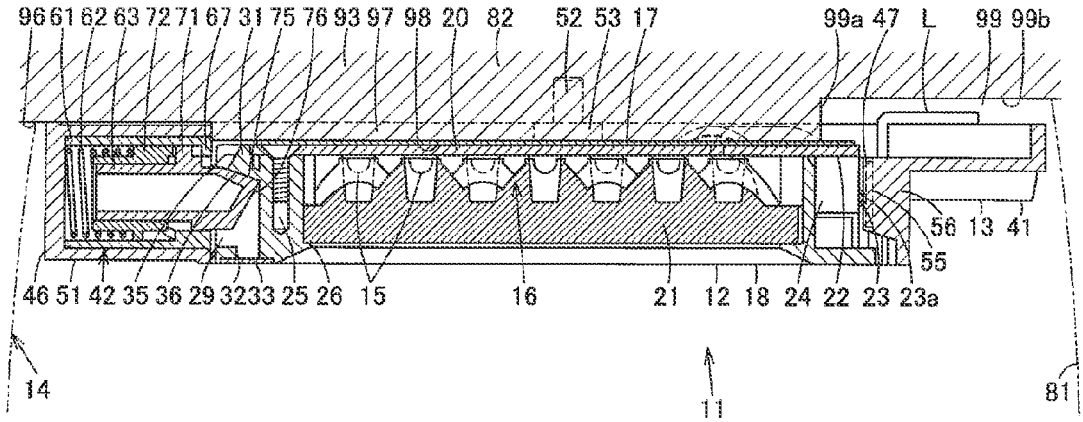
FIG. 1 is a sectional view of a part of a luminaire according to a first embodiment.
Figure 2:
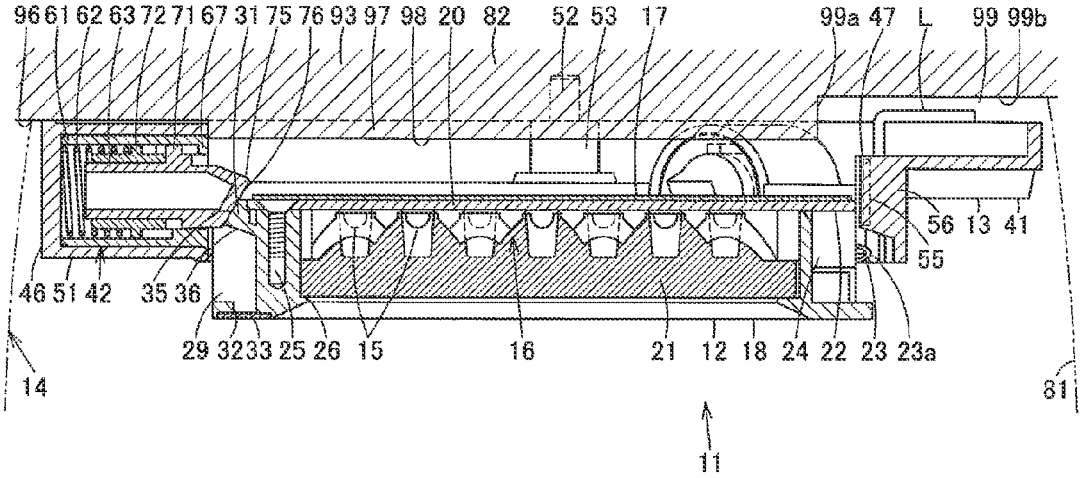
FIG. 2 is a sectional view of a part of a state immediately before a lamp of the luminaire is attached.

At this point, the upper inclined surfaces 35 of the locking protrusion parts 31 located in the engaging recesses 29 of the lamp 12 come into contact with the lower claw inclined surfaces 76 of the locking claws 63 of the locking lock units 42 (FIG. 2). When the lamp 12 is further pushed up, the locking claws 63 are pushed in to be retracted along the axis direction to the inside of the cylindrical guide section 61 along the inclination of the upper inclined surfaces 35 against the urging of the coil springs 62. When the locking protrusion parts 31 climb over the lower claw inclined surfaces 76 upward, the locking claws 63 are returned to the original positions thereof and advanced by the urging of the coil springs 62. The upper claw inclined surfaces 75 of the locking claws 63 come into contact and fit with the lower inclined surfaces 36 of the locking protrusion parts 31. The locking lock units 42 support the lamp 12 from the lower side (FIG. 1).

The contacts 23 of the lamp 12 move in slide contact with the terminals 55 of the socket 13 while the distal ends 23*a* are elastically deformed. Electrical connection of the contacts 23 and the terminals 55 are obtained.

In this way, the lamp 12 can be attached to the socket 13 in a simple operation only by being pushed into the socket 13.

In the attached state of the lamp 12, the LED module substrate 16 of the lamp 12 is in close contact with the contact surface 98 of the thermal radiator 82 via the thermal radiation sheet 17. Heat can be efficiently conducted from the lamp 12 to the thermal radiator 82.

When the lamp 12 is detached from the luminaire 11, the closing members 33 are detached to open the openings 32. An appropriate jig (not shown) is inserted into the openings 32 to retract the locking claws 63 of the locking lock units 42 against the urging of the coil springs 62 and unlock the lamp 12. Thereafter, the lamp 12 is detached.

Lighting of the lamp 12 is explained.

Direct-current power is supplied from the power supply line to the LEDs 15 through the terminal blocks 85, the terminals 55 (the output lines L) of the socket 13, and the contacts 23 of the lamp 12 to light the LEDs 15. Light radiated by the lighting of the LEDs 15 is transmitted through the light control unit 21 and emitted from the emission opening 26 of the luminaire main body 14.

During the lighting, heat generated by the LEDs 15 of the LED module substrate 16 is (e.g., mainly and efficiently) thermally conducted from the substrate main body 20 of the LED module substrate 16 to the thermal radiator 82, which is in close contact with the thermal radiation sheet 17 thermally joined to the substrate main body 20. The heat is radiated to the air from the surface including the plurality of thermal radiation fins 94 of the thermal radiator 82.

At this point, convection of the air passing the thermal radiator 82 from the lower surface side to the upper surface side can be formed through the gaps 101 among the plurality of thermal radiation fins 94 by the convection forming section 91 formed outside of the main body section 88. Therefore, it is possible to efficiently radiate the heat from the thermal radiator 82.

Some of the heat thermally conducted from the lamp 12 to the thermal radiator 82 are respectively thermally conducted to the luminaire main body 14, the plurality of attachment springs 83, and the attachment plate 84 and radiated to the air therefrom.

As explained above, in the first embodiment, the locking claws 63 of the locking lock units 42 urged in the horizontal direction crossing the up-down direction, which is the attaching direction of the lamp 12, are provided. The locking claws 63 are retracted against the urging of the coil springs 62 by being brought into contact with the locking protrusion parts 31 of the lamp 12 by push-in of the lamp 12 in the attaching direction. Thereafter, when the locking protrusion parts 31 climb over the locking claws 63, the locking claws 63 are returned to the original positions and advanced by the urging of the coil springs 62 to lock the lamp 12 in the locking protrusion parts 31. Therefore, the lamp 12 can be easily attached to the socket 13 simply by pushing the lamp 12 in the attaching direction. Compared with a configuration for, for example, attaching the lamp 12 to the socket 13 by rotating the lamp 12, it is possible to attach the lamp 12 to the socket 13 with a simple configuration and inexpensively manufacture the luminaire 11.

A second embodiment is explained with reference to FIGS. 10 to 15. The same components and the like as those described in the first embodiment are denoted by the same reference numerals and signs and explanation of the components and the like is omitted.

In the second embodiment, supported protrusion parts 111 functioning as supported sections are respectively protrudingly provided in the lamp 12 instead of the engaging recesses 29 (e.g., the locking protrusion parts 31) in the first embodiment. Support bearing springs 112 functioning as elastic supporting sections are respectively arranged in the socket 13 instead of the locking lock units 42.

The supported protrusion parts 111 are formed in a columnar shape. The supported protrusion parts 111 project radially along the radial direction from the outer circumferential edge of the cover section 18. The supported protrusion parts 111 are spaced apart (e.g., at substantially equal intervals (substantially equal angles)) in the circumferential direction of the cover section 18.

The support bearing springs 112 are respectively attached to attachment sections 114 formed in the annular section 45 of the socket main body 41. The attachment sections 114 communicate with the inner side of the inner cylinder 47 through cutout openings 115 cut out and formed at the lower end of the inner cylinder 47. The support bearing springs 112 are formed by bending elastic metal plates or the like in a C shape. Each of the support bearing springs 112 integrally includes a pair of receiving pieces 112*a* on both sides and a coupling section 112*b* that couples the upper ends of the receiving pieces 112*a*. Lower ends of the receiving pieces 112*a* are expanded downward to be gradually separated from each other to form receiving sections 112*c* that receive the supported protrusion part 111. Upper parts of the receiving sections 112*c* of the receiving pieces 112*a* are formed as supporting sections 112*d* curved to be separated more narrowly than the supported protrusion part 111. Further, a fixing piece 112*e* for fixing the support bearing spring 112 to the socket main body 41 is extended and folded back in the coupling section 112*b*.

Figure 10:
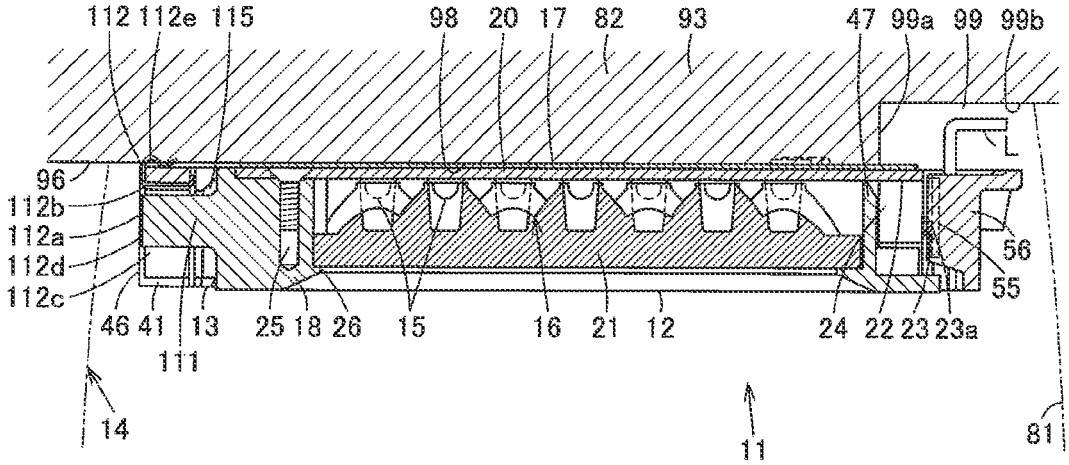
FIG. 10 is a sectional view of a part of a luminaire according to a second embodiment.
Figure 11:
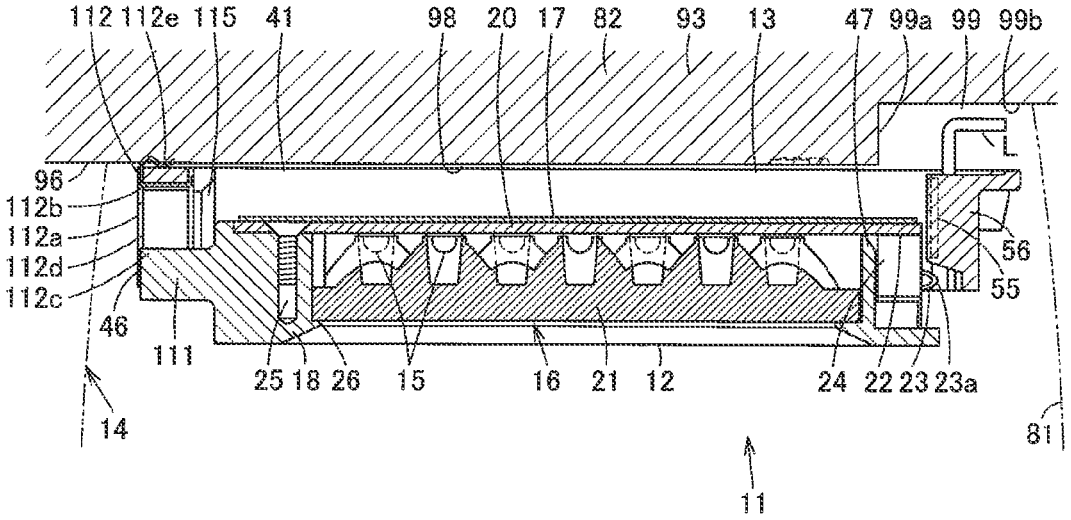
FIG. 11 is a sectional view of a part of a state immediately before a lamp of the luminaire is attached.
Figure 12:
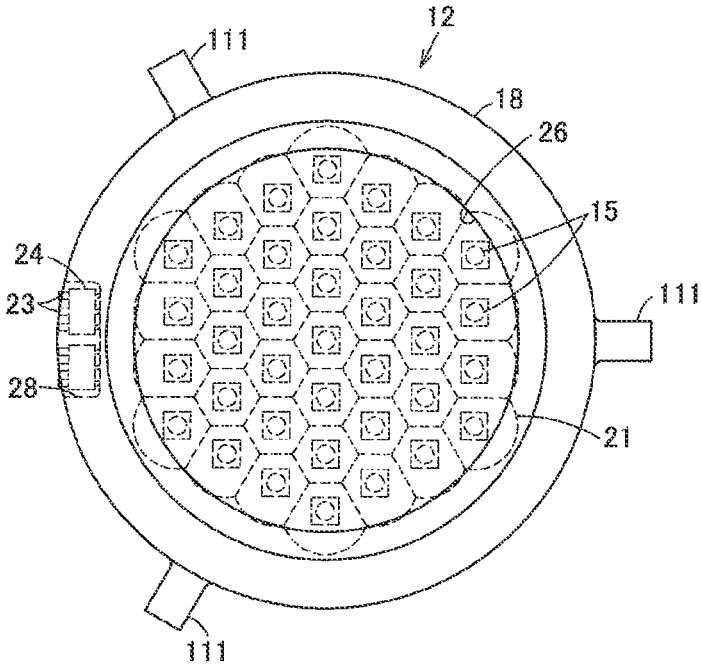
FIG. 12 is a plan view of the lamp.
Figure 13:
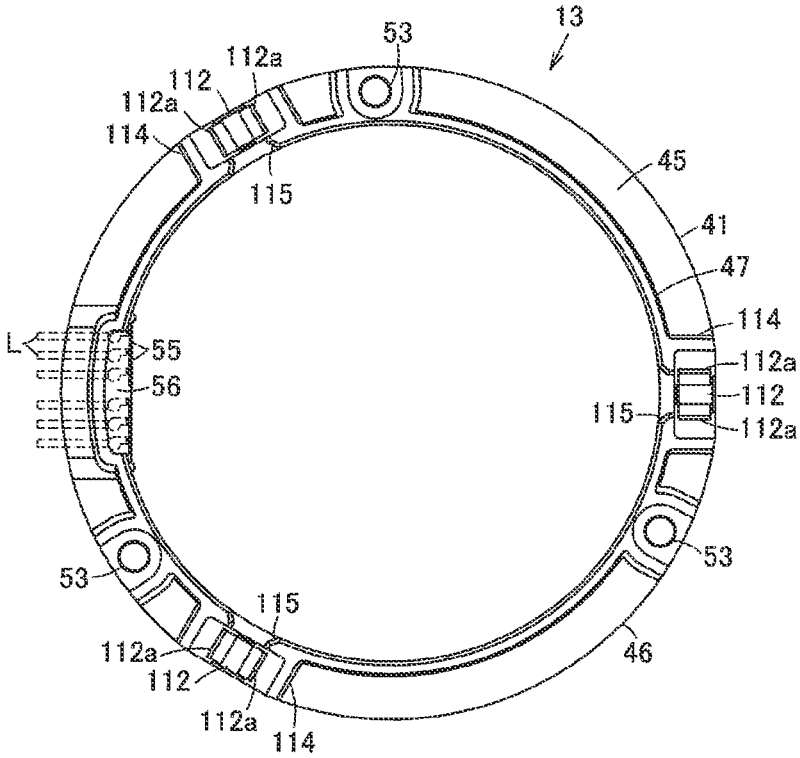
FIG. 13 is a plan view of a socket of the luminaire.
Figure 14:
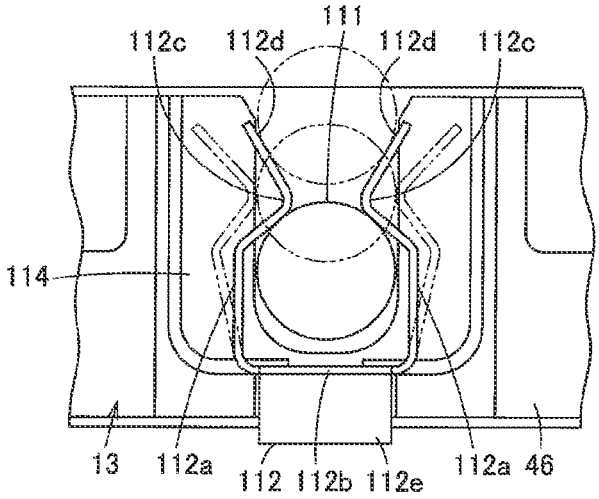
FIG. 14 is a side view of a part of the socket.
Figure 15:
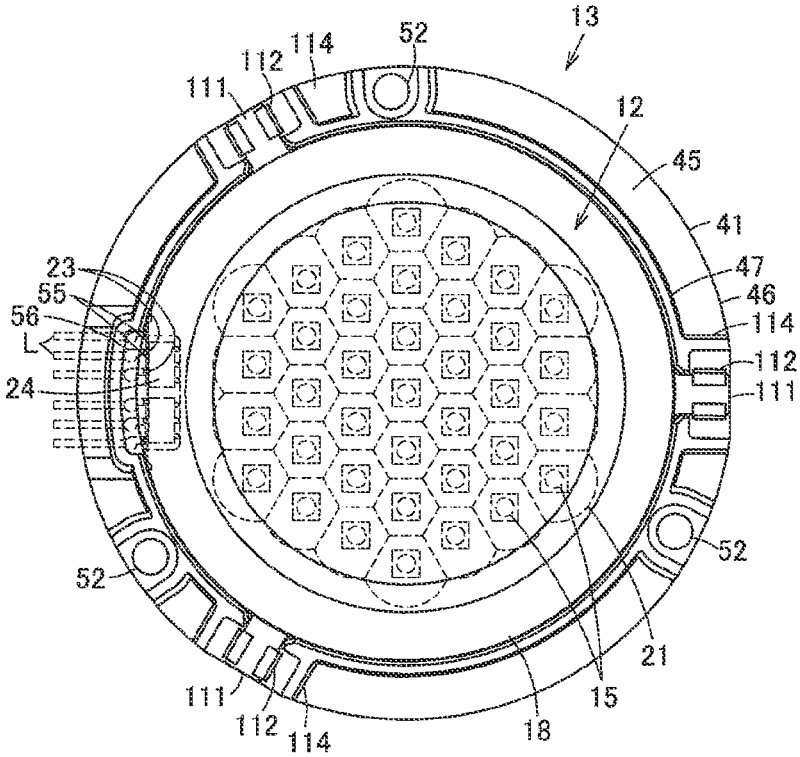
FIG. 15 is a plan view of a state in which the lamp is attached to the socket.

When the lamp 12 is attached to the socket 13, the lamp 12 is inserted into the inside of the main body section 88 of the luminaire main body 14. Each supported protrusion part 111 is pushed up in the upward direction, which is the attaching direction, in a state in which the supported protrusion part 111 is aligned with each support bearing spring 112. Then, the supported protrusion part 111 comes into contact with the receiving sections 112*c* of the support bearing spring 112 (FIG. 11). When the lamp 12 is further pushed up, the supported protrusion part 111 pushes to open and elastically deform the supporting sections 112*d*. When the supported protrusion part 111 climbs over the supporting sections 112*d*, the receiving pieces 112*a* of the support bearing spring 112 are deformed to be returned to the original shape thereof. Consequently, the supported protrusion part 111 is held among the receiving pieces 112*a*, the supporting sections 112*d*, and the coupling section 112*b* to support the lamp 12 from the lower side (FIG. 10).

As explained above, in the second embodiment, the plurality of supported protrusion parts 111 are protrudingly provided in the cover section 18 of the lamp 12. The plurality of support bearing springs 112 are provided in the socket 13. The support bearing springs 112 are elastically deformed by being brought into contact with the supported protrusion parts 111 by push-in of the lamp 12 in the attaching direction. Thereafter, when the supported protrusion parts 111 climb over the supporting sections 112*d*, the support bearing springs 112 are deformed to be returned to the original shape, whereby the supported protrusion parts 111 are held by the support bearing springs 112. Therefore, the lamp 12 can be easily attached to the socket 13 by simply pushing the lamp 12 in the attaching direction. Compared with a configuration for, for example, attaching the lamp 12 to the socket 13 by rotating the lamp 12, it is possible to attach the lamp 12 to the socket 13 with a simple configuration and inexpensively manufacture the luminaire 11.

The support bearing springs 112 are not moved and deformed in the radial direction of the socket 13. Therefore, it is unnecessary to secure a space for the movement and the deformation of the support bearing springs 112. It is possible to further increase the size of the lamp 12 and expect an increase in a light amount.

Figure 16:
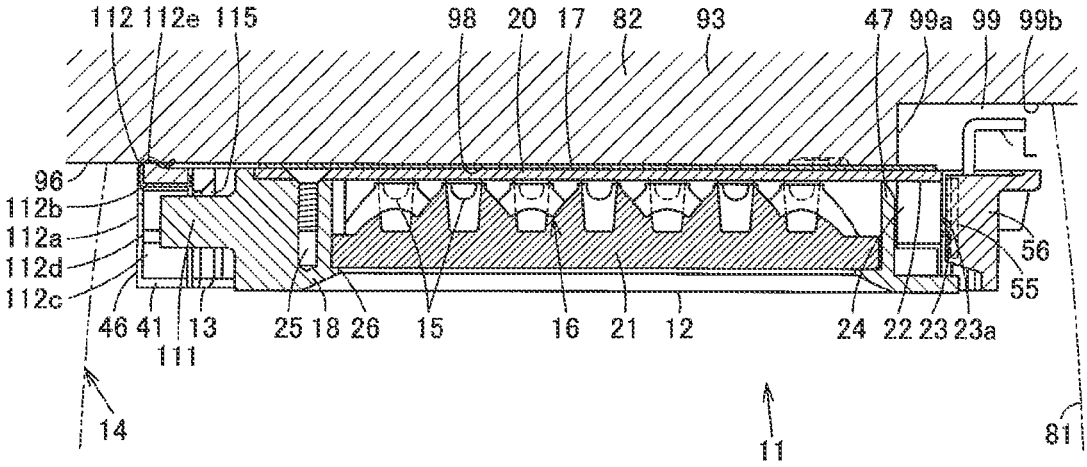
FIG. 16 is a sectional view of a part of a luminaire according to a third embodiment.
Figure 17:
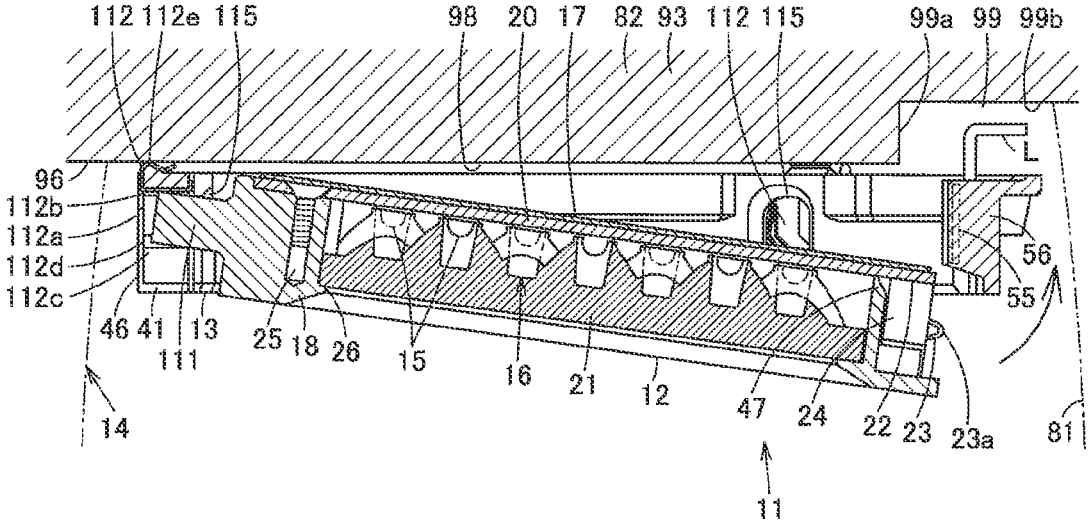
FIG. 17 is a sectional view of a part of a state immediately before a lamp of the luminaire is attached.

In the second embodiment, as in a third embodiment shown in FIGS. 16 and 17, the inner diameter of the inner cylinder 47 of the socket 13 may be increased and one supported protrusion part 111 located on the opposite side of the contacts 23 (e.g., the contact section 24) of the lamp 12 may be supported by the support bearing spring 112 corresponding to the supported protrusion part 111 (FIG. 17). Thereafter, the contacts 23 (e.g., contact section 24) side of the lamp 12 may be pushed in to be pivoted upward about the supported protrusion part 111 (e.g., the support bearing spring 112) to attach the lamp 12 to the socket 13 (FIG. 16).

Figure 18:
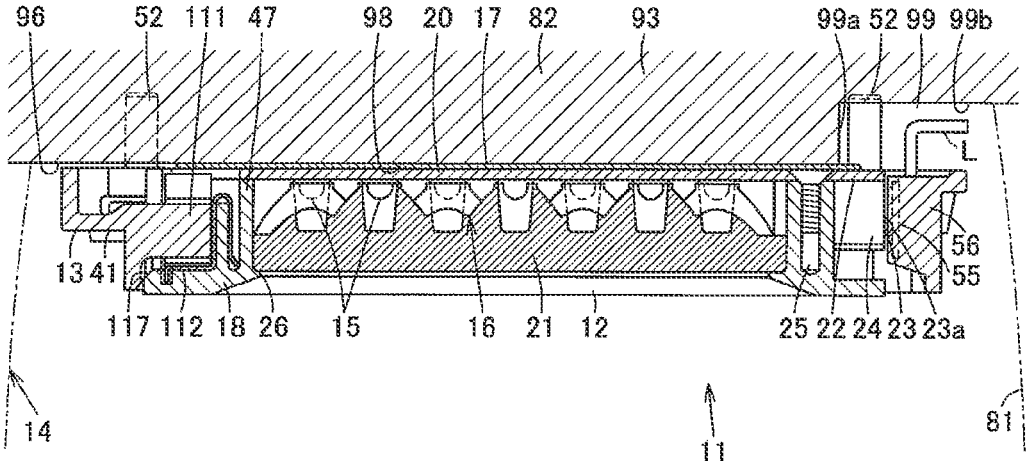
FIG. 18 is a sectional view of a part of a luminaire according to a fourth embodiment.
Figure 19:
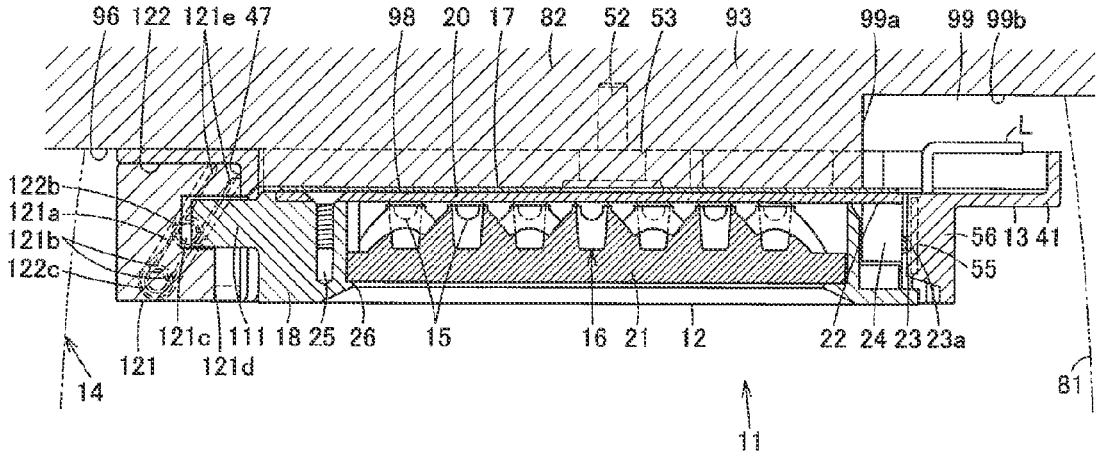
FIG. 19 is a sectional view of a part of a luminaire according to a fifth embodiment.
Figure 20:
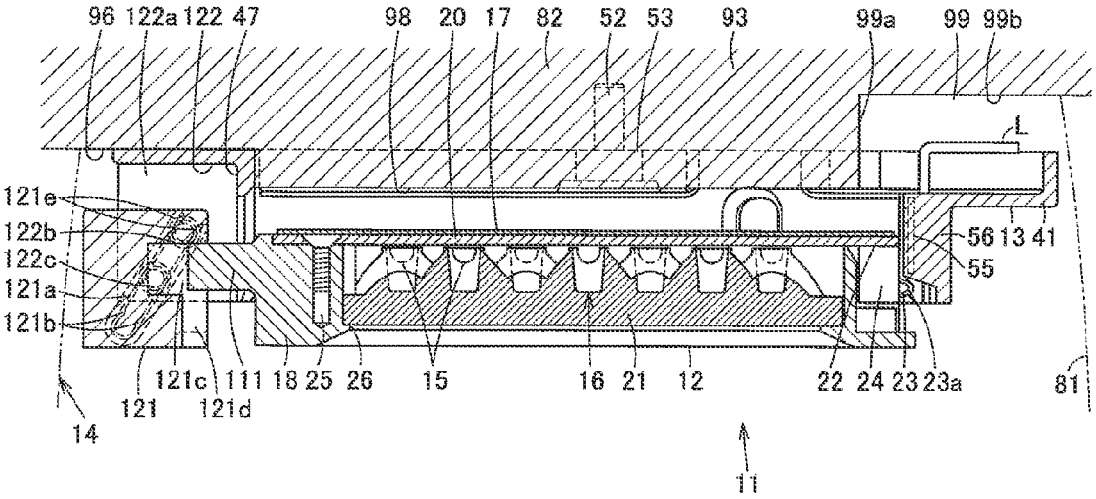
FIG. 20 is a sectional view of a part of a state immediately before a lamp of the luminaire is attached.

In the second embodiment, as in a fourth embodiment shown in FIG. 18, the support bearing springs 112 may be arranged in the cover section 18 of the lamp 12 and the supported protrusion parts 111 may be arranged in the socket 13. For example, spring attaching sections 117 functioning as elastic supporting section attaching sections, to which the support bearing springs 112 are attached, are cut out and formed over the outer circumferential edge and the bottom of the cover section 18 of the lamp 12. In other words, the spring attaching sections 117 are opened downward and outward of the cover section 18 of the lamp 12. The supported protrusion parts 111 are radially protrudingly provided toward the center side along the radial direction in the inner cylinder 47 of the socket 13. As in the second embodiment, the lamp 12 is inserted into the inner side of the main body section 88 of the luminaire main body 14. The lamp 12 is pushed up in the upward direction, which is the attaching direction, and inserted into the socket 13 in a state in which the support bearing springs 112 (e.g., the spring attaching sections 117) are aligned with the supported protrusion parts 111, whereby the lamp 12 is attached to the socket 13.

A fifth embodiment is explained with reference to FIGS. 19 to 22. The same components and the like as those described in the embodiments explained above are denoted by the same reference numerals and signs and explanation of the components and the like is omitted.

In the fifth embodiment, locking blocks 121 functioning as locking members are movably respectively arranged in the socket 13 instead of the support bearing springs 112 in the second embodiment.

The locking blocks 121 are formed in, for example, a rectangular parallelepiped shape. The locking blocks 121 are respectively attached to block attaching sections 122 functioning as locking member attaching sections provided in the annular section 45 of the socket 13. On both sides of the locking blocks 121, long groove-like guide groove sections 121*a* functioning as (e.g., one) locking member guide sections, which function as guides in moving the locking blocks 121 with respect to the socket 13, are recessed. The guide groove sections 121*a* incline along a substantially diagonal direction of the side surfaces of the locking blocks 121. Holding projections 121*b* are protrudingly provided to be opposed to each other on both sides in the vicinity of the lower ends on the inside of the guide groove sections 121*a*. The holding projections 121*b* are sections for holding the supported protrusion parts 111 of the lamp 12 between the holding projections 121*b* and the lower ends of the guide groove sections 121*a*. The width dimension of the guide groove sections 121*a* is reduced in the positions of the holding projections 121*b*. In the locking blocks 121, fitting receiving sections 121*c* functioning as receiving sections that receive the supported protrusion parts 111 of the lamp 12 are formed in a concave shape along the horizontal direction to be opened in a position on the inner side opposed to the lamp 12. Communicating cutout sections 121*d* that communicate with the fitting receiving sections 121*c* are cut out and formed along the up-down direction from the lower ends on the inner side.

The block attaching sections 122 are partitioned between a pair of wall sections 122*a* protrudingly provided in a rib shape in the up-down direction, which is the thickness direction of the annular section 45, and the lower surface of the annular section 45. Therefore, the block attaching sections 122 are opened downward and outward. In the wall sections 122*a*, columnar guide projections 122*b* functioning as (the other) locking member guide sections for guiding the locking blocks 121 and columnar locking projections 122*c* functioning as locking member locking sections for locking the locking blocks 121 are respectively protrudingly provided toward the inside of the block attaching sections 122.

The guide projections 122*b* are located on the upper inner side with respect to the locking projections 122*c*. In other words, the guide projections 122*b* and the locking projections 122*c* are arranged in a direction inclining with respect to the up-down direction. Further, the guide projections 122*b* and the locking projections 122*c* are respectively inserted into the guide groove sections 121*a* of the locking blocks 121. The guide projections 122*b* are prevented from slipping off the guide groove sections 121*a* by slip-off preventing sections 121*e* protrudingly provided on both sides in the vicinity of the upper ends of the guide groove sections 121*a*.

Figure 21:
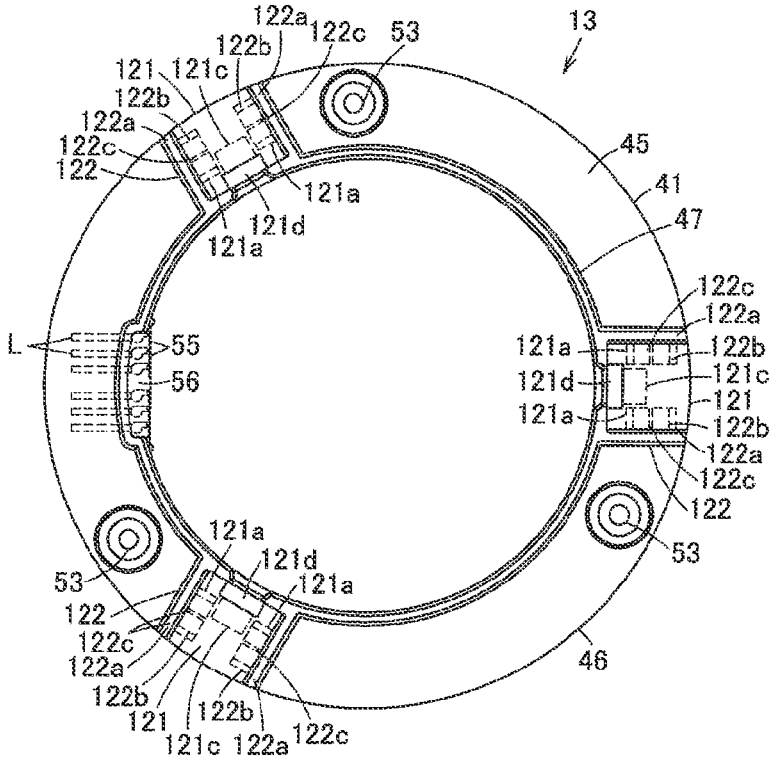
FIG. 21 is a plan view of a socket of the luminaire.
Figure 22:
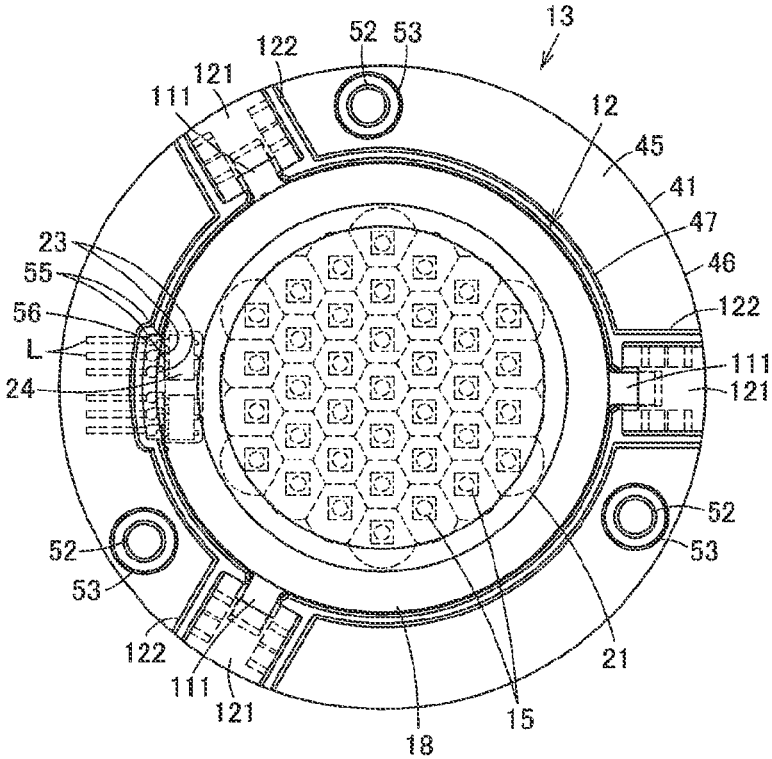
FIG. 22 is a plan view of a state in which the lamp is attached to the socket.

When the lamp 12 is attached to the socket 13, the lamp 12 is inserted into the inner side of the main body section 88 of the luminaire main body 14. The lamp 12 is pushed up in the upward direction, which is the attaching direction, in a state in which the supported protrusion parts 111 are inserted from the communicating cutout sections 121*d* of the locking blocks 121 (FIG. 22). Then, the supported protrusion parts 111 come into contact with the fitting receiving sections 121*c*, whereby the locking blocks 121 are integrally pushed up. At this point, the guide projections 122*b* and the locking projections 122*c* are inserted in the guide groove sections 121*a*. Therefore, the locking blocks 121 are guided and moved in an inclined form to the upper inner side to gradually approach the inner cylinder 47 side in the block attaching sections 122 of the socket 13. The locking blocks 121 gradually approach the outer circumference of the lamp 12, whereby the supported protrusion parts 111 of the lamp 12 are gradually inserted into the fitting receiving sections 121*c* of the locking blocks 121. When the locking projections 122*c* climb over the holding projections 121*b* in the guide groove sections 121*a*, the locking projections 122*c* are held between the holding projections 121*b* and the lower ends of the guide groove sections 121*a*. The locking blocks 121 are locked to the socket 13 (FIG. 21). As a result, the supported protrusion parts 111 of the lamp 12 are held in a state in which the supported protrusion parts 111 are inserted in the fitting receiving sections 121*c* of the locking blocks 121. The socket 13 supports the lamp 12 from the lower side.

As explained above, according to the fifth embodiment, the plurality of supported protrusion parts 111 are protrudingly provided in the cover section 18 of the lamp 12. The plurality of locking blocks 121 are movably provided in the socket 13. The locking blocks 121 gradually move to the lamp 12 side by being brought into contact with the supported protrusion parts 111 by push-in of the lamp 12 in the attaching direction. The lamp 12 is locked to the socket 13 in a state in which the supported protrusion parts 111 are held.

Therefore, the lamp 12 can be easily attached to the socket 13 simply by pushing the lamp 12 in the attaching direction. Compared with a configuration for, for example, attaching the lamp 12 to the socket 13 by rotating the lamp 12, it is possible to attach the lamp 12 to the socket 13 with a simple configuration and inexpensively manufacture the luminaire 11.

According to at least one of the embodiments explained above, the thermal radiation sheet 17 that covers the upper surface, which is the other plane, of the substrate main body 20 of the LED module substrate 16 is brought into contact with and thermally connected to the thermal radiator 82. Therefore, it is possible to obtain satisfactory thermal radiation properties. Further, the recess 99, which is the insulating section, is interposed between the terminals 55 of the socket 13 and the thermal radiator 82. Therefore, it is possible to secure an insulation distance to the thermal radiator 82.

The lamp 12 can be easily attached to the socket 13 simply by pushing the lamp 12 in the attaching direction. Therefore, unlike the configuration for attaching the lamp 12 to the socket 13 by rotating the lamp 12, it is unnecessary to form the thermal radiation sheet 17 as, for example, a hard component that easily slips against the thermal radiator 82. The thermal radiation sheet 17 can be formed of a soft member such as a silicone sheet that may be excellent in thermal radiation properties (e.g., thermal conductivity) and directly brought into contact with the thermal radiator 82. Therefore, it is possible to suppress an increase in thermal resistance, transfer thermal radiation from the LED module substrate 16 (the LEDs 15) directly to the thermal radiator 82 from the thermal radiation sheet 17 without involving a thermal loss, and obtain satisfactory thermal radiation properties.

Further, the recess 99 is provided in the thermal radiator 82 as the insulating section. Therefore, it is possible to easily secure insulation properties without using a separate insulative member.

In the embodiments, as the light sources, besides the LEDs 15, other light sources such as semiconductor light-emitting devices (e.g., solid-state light-emitting devices), for example, and/or organic EL devices can be used.

The insulating section is not limited to the recess 99. For example, an insulative member may be interposed in a position opposed to a terminal of the thermal radiator 82. An insulative member may be fit in the inside of the recess 99.

While certain embodiments have been described, these embodiments have been presented by way of example only, and are not intended to limit the scope of the inventions. Indeed, the novel systems and methods described herein may be embodied in a variety of other forms; furthermore, various omissions, substitutions and changes in the form of the systems described herein may be made without departing from the spirit of the inventions. The accompanying claims and their equivalents are intended to cover such forms or modifications as would fall within the scope and spirit of the inventions.

What is claimed is:

1. A luminaire comprising:

a lamp including a module substrate and a cover section, the module substrate including a substrate main body, a light source mounted on one plane of the substrate main body, and a contact disposed at an edge of the one plane of the substrate main body and electrically connected to the light source, wherein the cover section covers the module substrate while exposing the contact;

a socket configured to receive attachment of the lamp, the socket including a terminal configured to electrically connect to the contact by the attachment of the lamp;

a luminaire main body including a conductive thermal radiator having a connecting section and an insulating section provided in a position opposed to the terminal of the socket, wherein the lamp contacts and thermally connects with the connecting section when the lamp is attached to the socket;

a plurality of lamp-side locking sections provided in the cover section of the lamp; and a plurality of socket-side locking sections provided in the socket, the plurality of socket-side locking sections configured to be:

urged, by an urging force, in a direction perpendicular to an attaching direction of the lamp, retracted against the urging force by being brought into contact with the lamp-side locking sections by insertion of the lamp into the socket in the attaching direction, and subsequently returned to original positions by the urging force to lock the lamp in the lamp-side locking sections.

2. The luminaire according to claim 1, wherein the insulating section is a recess formed in the thermal radiator.

3. A luminaire comprising:

a lamp including a module substrate and a cover section, the module substrate including a substrate main body, a light source mounted on one plane of the substrate main body, and a contact disposed at an edge of the one plane of the substrate main body and electrically connected to the light source, wherein the cover section covers the module substrate while exposing the contact;

a socket configured to receive attachment of the lamp, the socket including a terminal configured to electrically connect to the contact by the attachment of the lamp;

a luminaire main body including a conductive thermal radiator having a connecting section and an insulating section provided in a position opposed to the terminal of the socket, wherein the lamp contacts and thermally connects with the connecting section when the lamp is attached to the socket;

a plurality of supported sections protrudingly provided in one of the cover section of the lamp and the socket; and a plurality of elastic supporting sections provided in the other one of the cover section of the lamp and the socket, wherein the plurality of elastic supporting sections are configured to be elastically deformed by being brought into contact with the supported sections by insertion of the lamp into the socket in an attaching direction and to be subsequently returned to an original shape to hold the supported sections.

4. The luminaire according to claim 3, wherein:

the supported sections are provided in the cover section of the lamp, the elastic supporting sections are provided in the socket, and the lamp is configured to be attached to the socket by being pushed into the socket while pivoting a terminal connection side of the lamp to a socket side in a state in which one of the supported sections located on an opposite side of the terminal is supported in one of the elastic supporting sections of the socket.

5. A luminaire comprising:

a lamp including a module substrate and a cover section, the module substrate including a substrate main body, a light source mounted on one plane of the substrate main body, and a contact disposed at an edge of the one plane of the substrate main body and electrically connected to the light source, wherein the cover section covers the module substrate while exposing the contact;

a socket configured to receive attachment of the lamp, the socket including a terminal configured to electrically connect to the contact by the attachment of the lamp;

a luminaire main body including a conductive thermal radiator having a connecting section and an insulating section provided in a position opposed to the terminal of the socket, wherein the lamp contacts and thermally connects with the connecting section when the lamp is attached to the socket;

a plurality of supported sections protrudingly provided in the cover section of the lamp; and a locking member movably provided in the socket and configured to be moved to a lamp side by being brought into contact with the supported sections by insertion of the lamp into the socket in an attaching direction to be locked to the socket in a state in which the locking member supports the supported sections.

6. The luminaire according to claim 1, wherein the light source is a light emitting diode (LED).

7. The luminaire according to claim 1, wherein the lamp includes an insulative thermal radiation sheet thermally connected to another plane of the substrate main body and arranged to cover the other plane, and the cover section covers the module substrate while exposing the contact and the thermal radiation sheet.

8. The luminaire according to claim 7, wherein the thermal radiation sheet is thermally connected to the connecting section when the lamp is attached to the socket.

9. The luminaire according to claim 7, wherein the thermal radiation sheet is a silicone sheet.

* * * * *